US009320670B2

(12) United States Patent
Spade

(10) Patent No.: US 9,320,670 B2
(45) Date of Patent: Apr. 26, 2016

(54) METHOD AND APPARATUS FOR REHABILITATION OF INDIVIDUAL AFTER KNEE REPLACEMENT

(71) Applicant: Roger A Spade, Phoenix, AZ (US)

(72) Inventor: Roger A Spade, Phoenix, AZ (US)

( * ) Notice: Subject to any disclaimer, the term of this patent is extended or adjusted under 35 U.S.C. 154(b) by 414 days.

(21) Appl. No.: 13/987,225

(22) Filed: Jul. 12, 2013

(65) Prior Publication Data

US 2014/0039360 A1 Feb. 6, 2014

Related U.S. Application Data

(60) Provisional application No. 61/741,172, filed on Jul. 13, 2012.

(51) Int. Cl.
*A61H 1/02* (2006.01)

(52) U.S. Cl.
CPC ..... *A61H 1/024* (2013.01); *A61H 1/0259* (2013.01); *A61H 2001/0207* (2013.01); *A61H 2201/1269* (2013.01); *A61H 2201/5043* (2013.01); *A61H 2201/5069* (2013.01); *A61H 2203/0431* (2013.01)

(58) Field of Classification Search
CPC ..... A61H 1/00; A61H 1/02; A61H 1/0237; A61H 1/024; A61H 1/0244; A61H 1/0259; A61H 2201/0119; A61H 2201/0149; A61H 2201/0157; A61H 2201/1207; A61H 2201/1215; A61H 2201/14; A61H 2201/1481; A61H 2201/149; A61H 16/164; A61H 16/1642; A61H 16/1664; A61H 16/1669; A61H 2203/00; A61H 2203/04; A61H 2203/0425; A61H 2203/0431; A61H 2205/10; A61H 2205/102; A61H 2205/106; A61H 2201/0207; A61H 2201/1269; A61H 2201/5043; A61H 2201/5069
USPC ..... 601/5, 33
See application file for complete search history.

(56) References Cited

U.S. PATENT DOCUMENTS

| | | | | | |
|---|---|---|---|---|---|
| 4,549,534 | A * | 10/1985 | Zagorski | A61H 1/0259 | 601/104 |
| 4,934,694 | A * | 6/1990 | McIntosh | B23P 19/066 | 482/137 |
| 5,040,522 | A * | 8/1991 | Daniels | A61H 1/024 | 297/466 |
| 7,695,416 | B2 * | 4/2010 | Weiner | A61H 1/024 | 482/112 |
| 8,753,296 | B2 * | 6/2014 | Einav | A61B 5/7475 | 601/23 |
| 2002/0193710 | A1 * | 12/2002 | Main | A61H 1/0266 | 601/5 |
| 2003/0120186 | A1 * | 6/2003 | Branch | A61H 1/0259 | 601/34 |
| 2011/0160625 | A1 * | 6/2011 | Yefimov | A61H 1/0259 | 601/5 |
| 2013/0079683 | A1 * | 3/2013 | Ewing | A61H 1/024 | 601/5 |

* cited by examiner

*Primary Examiner* — Steven Douglas
(74) *Attorney, Agent, or Firm* — Tod R. Nissle, P.C.

(57) ABSTRACT

An apparatus is provided for rehabilitating an individual's leg after the individual has undergone a knee replacement. The apparatus reduces the individual's awareness of discomfort produced while increasing the range of motion of the individual's leg. The individual's awareness is decreased by having the individual focus simultaneously on a display screen indicating range of motion and on manually operating the apparatus to increase range of motion of the individual's lower leg.

1 Claim, 4 Drawing Sheets

METHOD AND APPARATUS FOR REHABILITATION OF INDIVIDUAL AFTER KNEE REPLACEMENT

CROSS-REFERENCE TO RELATED APPLICATIONS

This application claims priority based on provisional patent application Ser. No. 61/741,172, filed Jul. 13, 2012.

FIELD OF THE INVENTION

This application relates to apparatus to rehabilitate an individual after the individual's knee has been replaced.

BACKGROUND OF THE INVENTION

After a patient has his or her knee replaced with an artificial knee, his or her lower leg (calf) initially is at a right angle with respect to his or her upper leg (thigh). The patient must then undergo physical therapy to recover range of motion of his lower leg with respect to his or her upper leg.

Those of skill in the art have, for many years, investigated apparatus and methods to facilitate the rehabilitation of an individual's leg after the knee in the leg has been replaced with an artificial knee. Accordingly, it would be highly desirable to provide an improved method and apparatus to facilitate rehabilitation after a knee replacement.

Therefore, a principal object of the invention is to provide an improved method and apparatus for providing physical therapy to rehabilitate an individual subsequent to a knee replacement procedure.

BRIEF DESCRIPTION OF THE DRAWING(S)

This, and other and further objects of the invention will be apparent to those skilled in the art from the following detailed description thereof, taken in conjunction with the drawings, in which.

Figure 7:
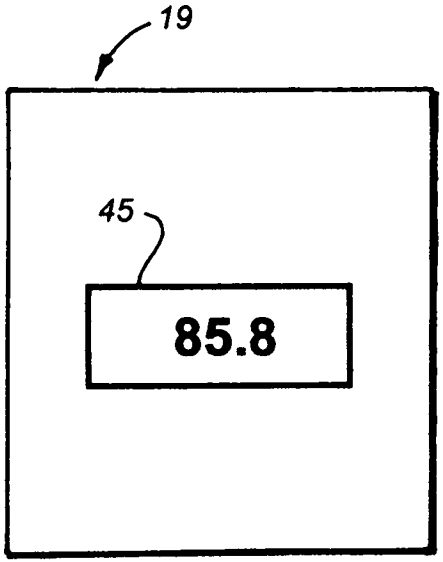
Figure 6:
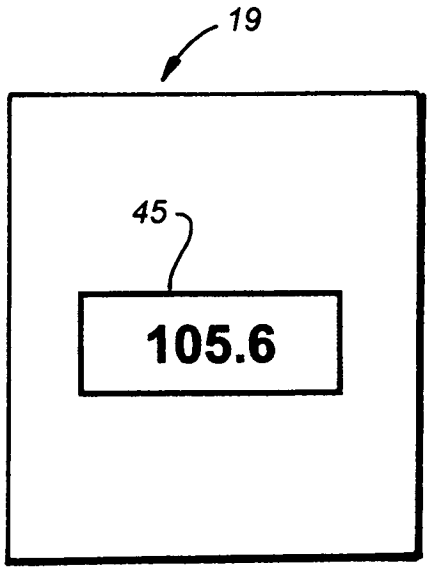
Figure 5:
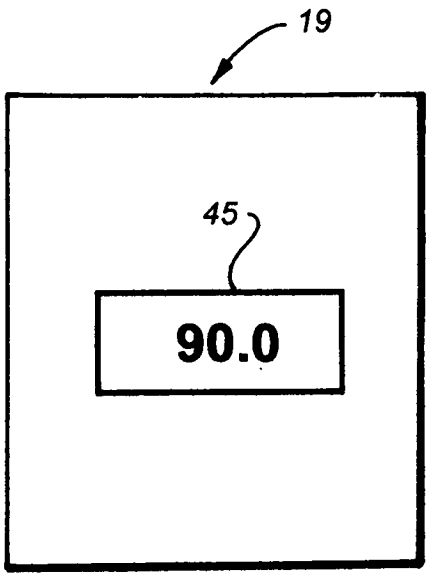
FIG. 5 is a front view illustrating the display in the apparatus of FIG. 1, along with the reading on the screen of the display which is visible when a patient seated in the apparatus of FIG. 1 begins utilizing the apparatus of FIG. 1 with the calf of a leg is in a first operative position with the calf vertically oriented and extending perpendicular to the floor.

FIG. 6 is a front view illustrating the reading on the display of FIG. 5 after the individual pushes (or pulls) the calf of a leg from the first operative position forwardly through an angle of 15.60 degrees; and, FIG. 7 is a front view illustrating the reading on the display of FIG. 5 after the individual pushes (or pulls) the calf of a leg from the first operative position rearwardly through an angle of 4.20 degrees.

BRIEF SUMMARY OF THE INVENTION

Briefly, in accordance with the invention, I provide an improved method to rehabilitate an individual's therapy leg after the knee in the therapy leg has been replaced with an artificial knee. The method including the steps of providing a rehabilitation apparatus. The rehabilitation apparatus includes a base; a seat mounted on the base at a height which prevents the individual's legs from contacting the ground when the individual is seated in the seat; a first strap in the seat to extend over the lower portion of the thigh of the leg of the individual; a support construct attached to and upwardly extending from the base; an axle member rotatably mounted on the support construct; an arm downwardly extending from the axle member and including a proximate end fixedly connected to the axle member and a distal end to rotate simultaneously with the axle member; a horizontally oriented foot rest mounted in the distal end of the arm; a brake member mounted on the axle member to rotate simultaneously with the axle member, the brake member including a contact surface; a pad member movable between at least two operative positions, a first operative position displaced in a direction away from the contact surface to permit the brake member and the axle member to rotate freely, and a second operative position displaced in a direction toward the contact surface to engage frictionally the contact surface to prevent the brake member and the axle member from rotating; a manually operable brake handle mounted on a side of the seat and operatively associated with the pad member, the brake handle movable between two operative positions, a primary operative position with the pad member in the first operative position, and a secondary operative position with the pad member in the second operative position; a plurality of upwardly extending spaced apart control handles attached to the axle member; a display unit mounted on the support construct and including a display screen to depict numerical readings indicating the angular position of the arm, the numerical readings including at least a first numerical reading when the arm is in a generally vertical orientation, a second numerical reading when the arm is displaced through an angle forwardly away from the vertical orientation, and a third numerical reading when the arm is displaced through an angle rearwardly away from the vertical orientation, the display screen being visible to the individual when the individual is seated in the seat; and, a sensor operatively associated with the display unit to determine the angular position of the arm and generate a signal to the display unit indicating the angular position. The improved method also includes the steps of seating the individual in the seat with the individual's calf extending downwardly from the seat toward the ground; securing the thigh of the individual's therapy leg with the first strap; positioning the arm and the foot rest such that the first reading is on the display screen; placing the ankle of the individual's therapy leg in front of the foot rest; and, instructing the individual to move one of the control handles to move the foot rest and push the ankle of the individual's therapy leg forwardly until the second numerical reading appears on the display screen, and watch continuously the display screen when moving the foot rest and the ankle.

The improved method also includes the additional subsequent steps of using manually one of the control handles to position the arm and the foot rest such that the first reading appears on the display screen; placing the ankle of the individual's therapy leg in back of the foot rest; instructing the individual to move one of the control handles to move the foot rest and push the ankle of the individual's therapy leg rearwardly until the third numerical reading appears on the display screen, and watch continuously the display screen when moving the foot rest and the ankle; using one of the control handles to position the arm and the foot rest such that the third reading appears on the display screen; instructing the individual to manually operate the brake handle to move the pad member to the second operative position by displacing the arm from the vertical orientation; and, manually operating the brake handle to move the pad member to the second operative position when the arm is displaced from the vertical orientation.

DETAILED DESCRIPTION OF A PREFERRED EMBODIMENT

Turning now to the drawings, which are presented by way of illustration and not limitation of the invention, and in which like reference characters refer to corresponding elements throughout the several views, FIGS. 1, 2, 5 to 7 illustrate rehabilitation apparatus including a base comprising vertically oriented member 13 upwardly depending from circular floor-engaging panel 13A. The base also comprises orthogonal floor-engaging member 13B outwardly depending from panel 13A. A seat 11 is mounted on the base at a height which prevents the individual's legs from contacting the ground when the individual is seated in seat 11. The apparatus can include means to adjust the height of seat 11 above the ground. Backrest 12 is adjustably attached to seat 11 and can slide toward and away from seat 11 in the manner indicated by arrows A in FIG. 1. A first strap 26 is secured to seat 11 and is constructed to extend over the lower portion of the thigh of one of the legs of the individual when the individual is seated in seat 11. A second strap 27 is secured to seat 11 and is constructed to extend over the lower portion of the lower portion of the thigh of the other one of the individual's legs when the individual is seated in seat 11. The length of each strap 26, 27 is, in conventional fashion, adjustable, and, in conventional fashion, each strap 26, 27 includes a buckle (not shown) for securing and releasing one end of the strap in a manner similar to that associated with a seat belt in an automobile. The other end of each strap 26, 27 is fixedly secured to seat 11. A support construct is attached to and upwardly extends from member 13B of the base. The support construct includes upwardly extending leg 14 and sleeve 15 adjustably slidably mounted on leg 14 such that the position of sleeve 15 can be adjusted in the directions indicated by arrow B in FIG. 1. Once sleeve 15 is slidably moved to a desired position, a set screw or quick release pin or other desired apparatus (not shown) is used to secure releasably sleeve 15 in fixed position on leg 14. The support construct also includes horizontally extending member 16 and sleeve 17 adjustably slidably mounted on member 16 for movement in the directions indicated by arrows C. Once sleeve 17 is slidably moved to a desired position, a set screw or quick release pin or other desired apparatus (not shown) is used to secure releasably sleeve 17 in fixed position on member 16. The adjustability of sleeves 15 and 17 is important in the practice of the invention because when an individual is seated on seat 11, the center 21 of disc 20 should be positioned laterally from the knees of the individual and centered on the knee (i.e., on the pivot point of the knee).

Figure 1:
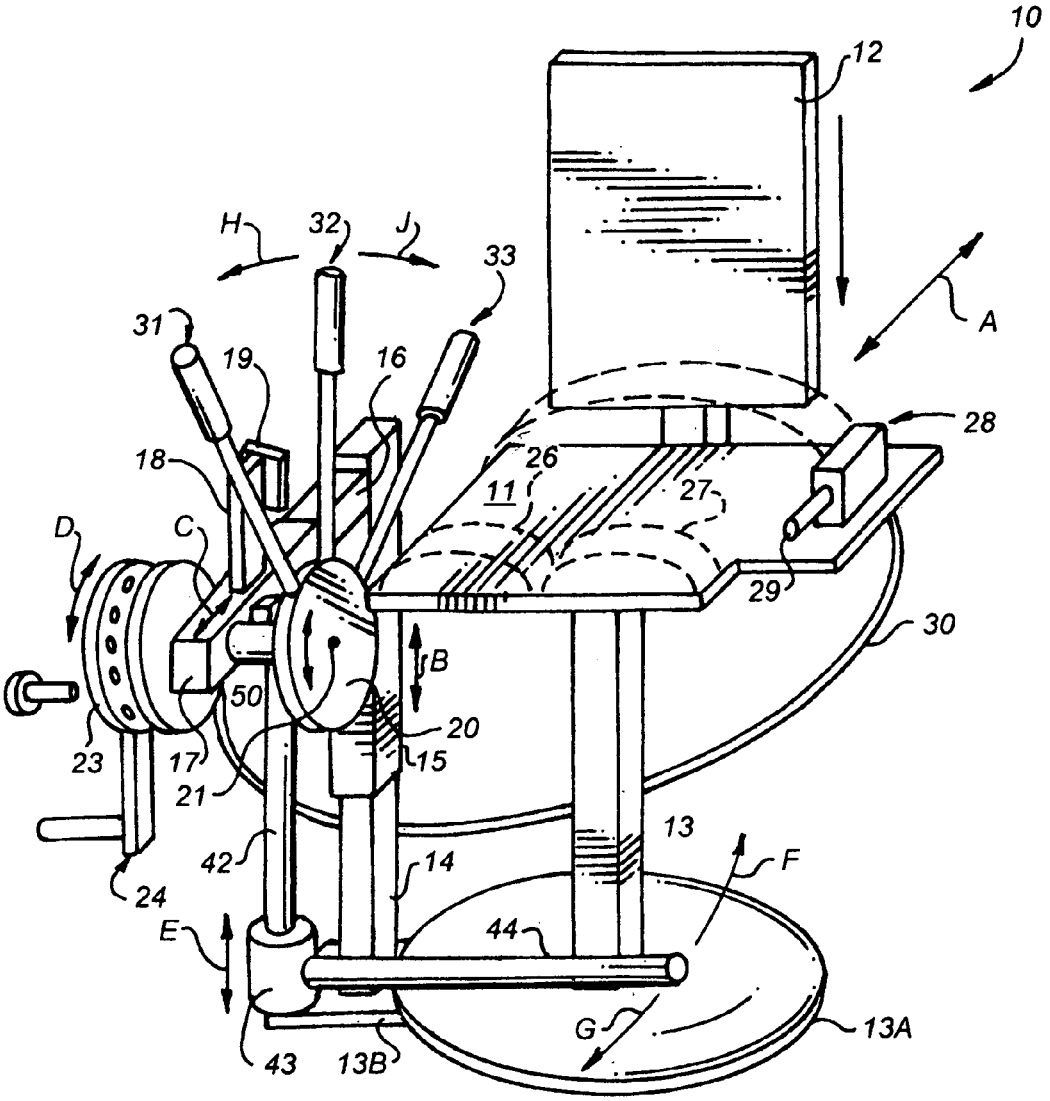
FIG. 1 is a perspective view illustrating apparatus constructed in accordance with the principles of the instant invention.
Figure 2:
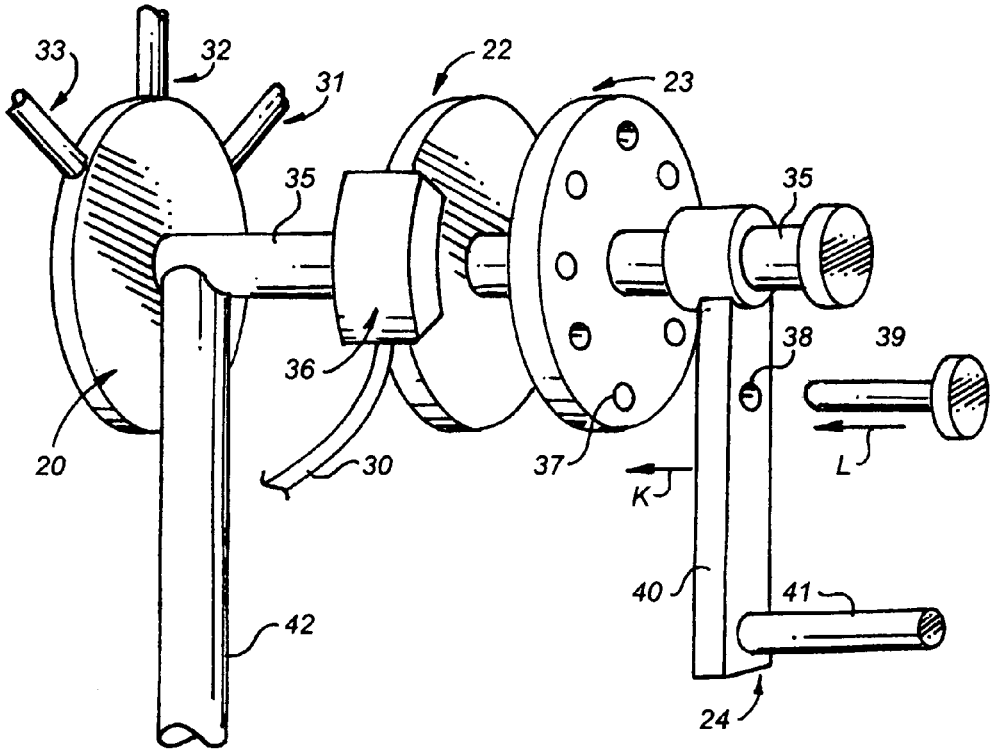
FIG. 2 is a perspective view illustrating a portion of the apparatus of FIG. 2, illustrating further construction details thereof.

Axle member 35 (FIG. 2) is rotatably mounted on the support construct. Arm 42 is fixedly attached to and downwardly extends from axle member 35 and includes a proximate, or upper, end fixedly connected to the axle member 35 and includes a distal end, or lower end. Arm 42 rotates simultaneously with axle member 35. Horizontally oriented foot rest 44 includes sleeve 43 slidably adjustably mounted on the distal end of arm 42. The position of sleeve 43 on arm 42 is slidably adjustable in the directions indicated by arrow E in FIG. 1. Once sleeve 43 is slidably moved to a desired position on arm 42, a set screw or other means is used to fix sleeve 43 in the desired position. In FIG. 1, arm 42 is cylindrical. The shape of arm 42 and each other component in FIGS. 1 and 2 can vary as desired. In particular, in the embodiment of the invention later described with reference to FIGS. 3 and 4, arm 42 has an orthogonal cross section. A strap (not shown) can be utilized to secure the ankle of an individual against foot rest 44. In one embodiment of the invention, a sleeve (not shown) slides along foot rest 44, and is, if desired, adjustably secured in a desired location on foot rest 44 with a set screw or other means. A strap is attached to the sleeve and is used to secure the foot of an individual against the sleeve. The sleeve can, for comfort, include an outer layer of soft cloth or foam material.

Cylindrical brake member 22 is fixedly mounted on axle member 35 and rotates simultaneously with axle member 35. Brake member 22 includes at least one generally circular contact surface, in the manner of the contact surfaces found on each rotor typically found in the disc brakes on at least the front wheels of many automobiles and pickup trucks. A pad member (not visible) mounted in housing 36 is movable between at least two operative positions, in the same manner that the pads in disc brakes in an automobile or pickup truck can be moved between two operative positions. The two operative positions include a first operative position displaced in a direction away from the contact surface to permit the brake member 22 and the axle member 35 to rotate freely, and include a second operative position displaced in a direction toward the contact surface to engage frictionally the contact surface to prevent the brake member 22 and the axle member 35 from rotating.

A manually operable brake handle 29 mounted in housing 28 on a side of seat 11 is operatively associated with the pad member, and is movable between two operative positions, a primary operative position with the pad member in the first operative position, and a secondary operative position with the pad member in the second operative position. Pulling up on handle 29 moves handle 29 from the first operative position to the second operative position. Handle 29 "catches" or locks in the second operative position in the same manner that the parking brake in an automobile can lock in a second operative position. Handle 29 is released from the second operative position to move back to the first operative position by pressing a button (not shown) located at the front of brake handle 29, again in the same manner as a parking brake often found in automobiles. Cable 30 interconnects housing 36 and housing 28. The ability of an individual seated in the apparatus of FIG. 1 to use brake 28, 29 is important in the practice of the invention because, the individual is, while using the apparatus, occupied both by using handles 29, 31 to 33 and by focusing on the screen 45 of display 19 (FIGS. 5, 6, 7). This tends to keep the individual's mind off the discomfort he or she suffers when trying to move his or her lower leg during rehabilitation of the individual's leg to improve the range of motion of the lower leg with respect to the upper leg.

A plurality of upwardly extending spaced apart control handles 31, 32, 33 are fixedly attached to disc 20. Disc 20 is fixedly attached to axle 35. Control handles 31 to 33 are each manually displaced in the directions indicated by arrows H and J.

Display unit 19 is mounted on sleeve 17 of the support construct and includes a display screen 45 to depict numerical readings indicating the angular position of arm 14. The numerical readings including at least a first numerical reading when the arm 14 is in a generally vertical orientation (for example, reading 90.0 degrees depicted on display screen 45 in FIG. 5) in the manner illustrated in FIG. 1; a second numerical reading when arm 14 is displaced through an angle forwardly in the direction of arrow G (FIG. 1) away from the vertical orientation (for example, reading 105.6 degrees depicted on display screen 45 in FIG. 6); and, a third numerical reading when arm 14 is displaced through an angle rearwardly in the direction of arrow F (FIG. 1) away from the vertical orientation (for example, reading 85.8 degrees depicted on display screen 45 in FIG. 7). The display unit 19 is positioned such that screen 45 is visible to an individual seated in seat 11.

Sensor 50 is operatively associated with display unit 19 to determine the angular position of arm 14 and generate a signal to the display unit indicating the angular position of arm 14. Sensor 50 monitors the rotational position of axle 35. Any desired sensor or system can be utilized to monitor the angular rotation and position of axle 35. Disc 23 (FIG. 2) is also mounted on axle 35 and includes a plurality of spaced apart apertures 37 formed therethrough. Weight storage handle 24 is pivotally slidably mounted on the distal end of axle 35 in the manner illustrated in FIG. 2 and includes aperture 38 formed through arm 40. Weight storage handle 24 can be slidably displaced in the direction of arrow K toward disc 23. Member 41 outwardly depends from arm 40. Quick release pin 39 is inserted in the direction of arrow K through aperture 38 and into an aperture 37 to insure that handle 24 and disc 23 move simultaneously with axle 35 in the directions indicated by arrow D in FIG. 1. Conventional cylindrically shaped barbell weights can be slidably mounted on member 41. An aperture is, in conventional fashion, formed through the center of each barbell weight and is shaped to slide onto member 41. Alternatively, as would be appreciated by those of skill in the art, if quick release pin 39 is removed from handle 24, handle 24 free wheels about axle 35.

Figure 3:
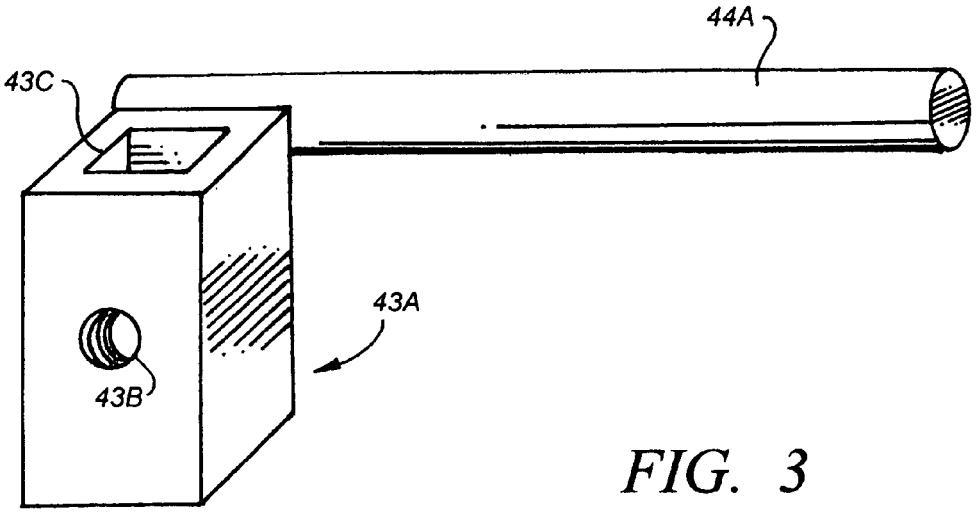
FIG. 3 is a perspective view illustrating an ankle support construct utilized on the apparatus of FIG. 1 in accordance with an alternate embodiment of the invention.
Figure 4:
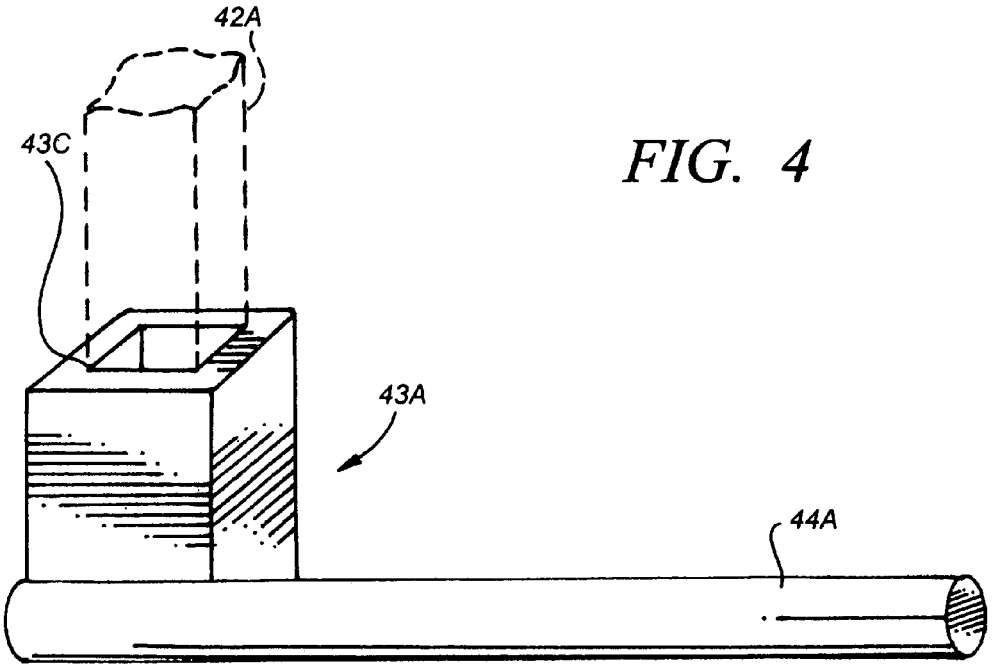
FIG. 4 is a perspective view illustrating the ankle support construct rotated one hundred and eighty degrees from the orientation illustrated in FIG. 3.

In FIGS. 3 and 4, cylindrical arm 42 of the apparatus of FIG. 1 has been replaced by an arm 42A having an orthogonal, and not a circular, cross-section. Further, foot rest 44 and sleeve 43 are replaced by foot rest 44A and sleeve 43A with orthogonal aperture 43C formed through sleeve 43A. Sleeve 43A slides along arm 42A in the direction of arrows E (FIG. 1) and is adjustably secured in position by a set screw (not shown) which turns into aperture 43B (FIG. 3) and against arm 42A.

An objective served by foot rest 44A—sleeve 43A is to position the center of an individual's ankle along the longitudinal centerline of arm 42A. In FIG. 1, the longitudinal centerline of arm 42A is vertically oriented and lies in a vertical plane which also passes through point 21 and through foot rest 44A. In accordance with this objective, when it is desired to push (or pull) an individual's foot forwardly in the direction of arrow G (FIG. 1), sleeve 43A is slid onto arm 42A in the orientation illustrated in FIG. 3, i.e., with foot rest 44A positioned toward the rear of sleeve 43A. Conversely, when it is desired to push (or pull) an individual's foot rearwardly in the direction of arrow F (FIG. 1), sleeve 43A is rotated 180 degrees from the orientation of FIG. 3 to the orientation illustrated in FIG. 4 and is slid onto arm 42A in the manner illustrated in FIG. 4. When foot rest 44A is in the orientation illustrated in FIG. 3, the position of sleeve 43A along arm 42A is adjusted such that when an individual is seated in seat 11, the back of an individual's ankle rests against foot rest 44A. When foot rest 44A is in the orientation illustrated in FIG. 4, the position of sleeve 43A along arm 42A is adjusted such that when an individual is seated in seat 11, the instep of an individual's foot rests against foot rest 44A.

The following description assumes that foot rest 44A, sleeve 43A, and arm 42A have been substituted in the apparatus of FIG. 1 for foot rest 44, sleeve 43, and arm 42. In use of the apparatus of FIGS. 1 to 7, an individual is seated in seat 11 with the individual's calf extending downwardly from seat 11 toward the ground. The individual's feet are positioned above the ground.

The thigh of the individual's therapy leg is secured with strap 26 or 27, as the case may be. If desired, both legs can be secured, one with strap 26, the other with strap 27. The individual's waist is secured with strap 25. Strap 25 functions like a seat belt in an automobile. Arm 42A and foot rest 44A are positioned such that the reading on the display screen is 90.0 degrees as illustrated in FIG. 5; i.e., arm 42A is vertically oriented and is perpendicular to the ground.

Sleeve 43A is mounted on arm 42A in the orientation illustrated in FIG. 3 and is adjusted to a position on arm 42A such that the ankle of the individual's therapy leg is in front of foot rest 44A with the back of the individual's therapy leg ankle bearing against foot rest 44A (or against a cushion on foot rest 44A). If desired, the individual's ankle is strapped or otherwise secured to foot rest 44A.

The individual is instructed to grasp and move one of control handles 31 to 33 in the direction of arrow J (FIG. 1) to move the foot rest 44A and push the ankle of the individual's therapy leg forwardly as far as reasonably possible, in which case a second new numerical reading will appear on the display screen 45. In FIG. 6, the new reading is 105.6, which means the individual has moved his or her lower leg through an angle of 15.6 degrees from the initial ninety degree position in which the lower leg of the individual was vertically oriented. When the individual is beginning therapy, it is unlikely that the initial movement achieved by the individual will be 15.6 degrees, and that it will be much less. Over time the individual gradually works at increasing the range of motion of her or her lower leg. Hopefully the individual will eventually be able to move his or her lower leg through an angle of forty-five degrees so that the display screen in FIG. 6 will read 45.0 degrees.

Importantly, when the individual is instructed to grasp and move a handle 31 and 33, the individual is also instructed to watch displace screen 45. When the individual watches screen 45, the individual can see the numerical value on the screen increase as the individual moves his lower leg forwardly in the direction of arrow G. In practice, after the individual initially watches screen 45, he or she tends to continue to do so and to focus on increasing the value of the number appearing on screen 45. Equally important, the patient often begins focusing so much on manually moving a control handle 31 to 33 and on screen 45 that the patient begins to ignore to a large extent the pain involved in attempting to move his lower leg. This expedites recovery and also typically results in a greater range of motion being achieved in comparison to conventional therapy treatments.

The foot of the patient's therapy leg is, after a selected period of time, removed from contact with foot rest 44A. Arm 42A and foot rest 44A are positioned such that the reading on the display screen is once again 90.0 degrees as illustrated in FIG. 5; i.e., arm 42A is vertical and perpendicular to the ground.

Sleeve 43A is slidably removed from arm 42A, inverted to the position shown in FIG. 4, and slid back onto arm 42A. Sleeve 43A is adjusted to a position on arm 42A such that the instep of the foot of the individual's therapy leg is behind and contacting foot rest 44A. If desired, the individual's ankle is then strapped or otherwise secured to foot rest 44A.

The individual is instructed to grasp and move one of control handles 31 to 33 in the direction of arrow H (FIG. 1) to move the foot rest 44A and push the instep of the individual's therapy leg rearwardly in the direction of arrow F (FIG. 1) as far as reasonably possible, in which case a third new numerical reading will appear on the display screen 45. In FIG. 6, the new reading is 85.8, which means the individual has moved his or her lower leg rearwardly through an angle of 4.2 degrees from the initial ninety degree position in which the lower leg of the individual was vertically oriented. When the individual is beginning therapy, the initial movement achieved by the individual may be less than 4.2 degrees. Over time the individual gradually works at increasing the rearward range of motion of her or her lower leg.

As was the case when the patient used control handles 31 to 33 to move foot rest 44A forwardly, when the individual is instructed to grasp a handle 31 and 33 to move foot rest 44A rearwardly, the individual is also instructed to watch displace screen 45. When the individual watches screen 45, the individual can see the numerical value on the screen decrease as the individual moves his lower leg rearwardly in the direction of arrow F. As noted above, after the individual initially watches screen 45, he tends to continue to do so and to focus on decreasing the value of the number appearing on screen 45. Equally important, the patient often begins focusing so much on manually moving a control handle 31 to 33 and on screen 45 that the patient begins to ignore to a large extent the pain involved in attempting to move his or her lower leg. This expedites recovery and also typically results in a greater range of motion being achieved in comparison to conventional therapy treatments. The use of the individual's other hand to operate brake handle 29 also functions to detract the individual's attention from discomfort which results when the individual's lower leg is moved forwardly or rearwardly.

At any desired time the individual can be instructed to or can use of her or her own volition handle 29 to engage the brake system described above and to maintain foot rest 44 (and the lower portion of the patient's therapy leg) in a desired position.

Once an individual has been instructed how to use the apparatus of FIGS. 1 to 7, one virtue of the apparatus is that the individual can, in general, be left alone to work on increasing the range of motion of his or her lower leg after the individual has had a knee replacement. This frees up physical therapists to work with other patients. The patient may still, however, need the assistance of a therapist to remove and invert sleeve 43A, or to otherwise change the position of sleeve 43A, when working on increasing both forward and rearward range of motion.

The invention claimed is:

1. A method to rehabilitate an individual's therapy leg after the knee in the therapy leg has been replaced with an artificial knee, the method including the steps of (a) providing a rehabilitation apparatus including (i) a base, (ii) a seat mounted on said base at a height which prevents the individual's legs from contacting the ground when the individual is seated in said seat, (iii) a first strap in the seat to extend over the lower portion of the thigh of the leg of the individual, (iv) a support construct attached to and upwardly extending from said base, (v) an axle member rotatably mounted on said support construct, (vi) an arm fixedly secured to and downwardly extending from said axle member and including a proximate end fixedly connected to said axle member and a distal end, said arm rotates simultaneously with said axle member, (vii) a horizontally oriented foot rest mounted in said distal end of said arm, (viii) a brake member mounted on said axle member to rotate simultaneously with said axle member, said brake member including a contact surface;

(ix) a pad member movable between at least two operative positions, a first operative position displaced in a direction away from said contact surface to permit said brake member and said axle member to rotate freely, and a second operative position displaced in a direction toward said contact surface to engage frictionally said contact surface to prevent said brake member and said axle member from rotating, (x) a manually operable brake handle mounted on a side of said seat and operatively associated with said pad member, said brake handle movable between two operative positions, a primary operative position with said pad member in said first operative position, and a secondary operative position with said pad member in said second operative position, (xi) a plurality of upwardly extending spaced apart control handles attached to said axle member, (xii) a display unit mounted on said support construct and including a display screen to depict numerical readings indicating the angular position of said arm, said numerical readings including at least a first numerical reading when said arm is in a generally vertical orientation, a second numerical reading when said arm is displaced through an angle forwardly away from said vertical orientation, and a third numerical reading when said arm is displaced through an angle rearwardly away from said vertical orientation, said display screen visible to the individual when the individual is seated in said seat, and (xiii) a sensor operatively associated with said display unit to determine the angular position of said arm and generate a signal to said display unit indicating said angular position;

(b) seating the individual in said seat with the individual's calf extending downwardly from said seat toward the ground;

(c) securing the thigh of the individual's therapy leg with said first strap;

(d) positioning said arm and said foot rest such that said first reading is on said display screen (e) placing the ankle of the individual's therapy leg in front of said foot rest;

(f) instructing the individual to (i) move one of said control handles to move said foot rest and push said ankle of the individual's therapy leg forwardly until said second numerical reading appears on said display screen, and (ii) watch continuously said display screen when moving said foot rest and said ankle;

(g) using one of said control handles to position manually said arm and said foot rest such that said second reading appears on said display screen;

(i) placing the ankle of the individual's therapy leg in back of said foot rest;

(j) instructing the individual to (i) move one of said control handles to move said foot rest and push said ankle of the individual's therapy leg rearwardly until said third numerical reading appears on said display screen, and (ii) watch continuously said display screen when moving said foot rest and said ankle;

(k) using one of said control handles to position said arm and said foot rest such that said third reading appears on said display screen;

(l) instructing the individual to manually operate said brake handle to move said pad member to said second operative position when said arm is displaced from said vertical orientation; and, (m) manually operating said brake handle to move said pad member to said second operative position when said arm is displaced from said vertical orientation.

* * * * *